United States Patent [19]

Warnan et al.

[11] Patent Number: 4,861,297

[45] Date of Patent: Aug. 29, 1989

[54] RELEASABLE AIRBORNE BUOY PARTICULARLY FOR UNDERSEA LISTENING

[75] Inventors: Francois Warnan, Trappes; Joël Barbot, L'Hay Les Roses; Claude Brochard, Viry Chatillon, all of France

[73] Assignee: Thomson-CSF, Paris, France

[21] Appl. No.: 186,293

[22] Filed: Apr. 26, 1988

[30] Foreign Application Priority Data

Apr. 29, 1987 [FR] France ..... 87 06102

[51] Int. Cl.[4] ..... B63B 22/26

[52] U.S. Cl. ..... 441/33; 367/3

[58] Field of Search ..... 441/1, 32, 33; 367/3; 244/138 R

[56] References Cited

U.S. PATENT DOCUMENTS 3,161,896 12/1964 Holt et al. ..... 441/33
3,889,224 6/1975 Reed et al. ..... 441/33
3,992,736 11/1976 Reed, III et al. ..... 441/33
4,279,025 7/1981 Suppa ..... 441/33

FOREIGN PATENT DOCUMENTS 0007830 2/1980 European Pat. Off. ..... 441/33

*Primary Examiner*—Joseph F. Peters, Jr.
*Assistant Examiner*—Jesûs D. Sotelo
*Attorney, Agent, or Firm*—Oblon, Spivak, McClelland, Maier & Neustadt

[57] ABSTRACT

A buoy released from an aircraft for carrying out under water listening includes a balloon fixed to a body by way of a set of halyards extending from the top to the base of the balloon and fixed inside the neck of the body of the buoy. The inflation air penetrates into this neck then into the balloon through triangular openings formed in the neck. A textile sleeve fixed to the internal wall of the neck above the inflation openings turns inside out after impact on the water so as to close these openings, which avoids deflation of the balloon and loss of the buoy.

3 Claims, 2 Drawing Sheets

RELEASABLE AIRBORNE BUOY PARTICULARLY FOR UNDERSEA LISTENING

BACKGROUND OF THE INVENTION

The present invention relates to buoys which are released from an aircraft on to the surface of the sea, and more particularly to acoustic buoys provided with hydrophones for picking up undersea sounds and retransmitting them by radio to a reception station situated very often in the releasing aircraft.

Such buoys are known more particularly from French Patent No. 2 431 419 and its addition No. 2 464 179 filed in the name of the applicant.

These buoys comprise a device for braking and stabilizing their fall so as to essentially limit the shock effects on impact with the water. This device is formed of a balloon which also serves as float for the buoy after it has reached the water. A hydrophone situated at the lower part of the buoy descends automatically to a given depth when the buoy floats on the water. It picks up the acoustic sounds propagated in the water and transmits them to a radio transmitter contained in the body of the buoy which feeds an antenna supported by the balloon.

The balloon is folded up inside the body of the buoy and is inflated during the fall through a forced air inlet situated at the upper part of the body of the buoy. The lower end of the balloon is crimped to a circular support surrounding the body of the buoy, to which it is held by radial spacers which define a circular space for the forced inlet of air into the balloon. The balloon is further provided with pockets in its upper part, through which the air passes to leave through smaller upper openings, which provides aerodynamic stability of the assembly during the descent through the air.

The system for fixing the float balloon to the body of the buoy by means of a circular support and crimping the balloon to the outside of this support has a certain mechanical fragility. Moreover, the assembly is relatively complex, which leads to fairly high constructional costs.

SUMMARY OF THE INVENTION

To overcome these drawbacks, the invention proposes fixing the float balloon to the body of the buoy by means of a set of halyards fixed to the inside of the neck of the buoy. It also proposes providing this neck with a reversible flexible sleeve which, under the effect of the water pressure, closes the air inlet orifices into the balloon.

BRIEF DESCRIPTION OF THE DRAWINGS

Other features and advantages of the invention will be clear from the following description given by way of non limitative example, with reference to the accompanying figures which show.

DESCRIPTION OF THE PREFERRED EMBODIMENT

Figure 1:
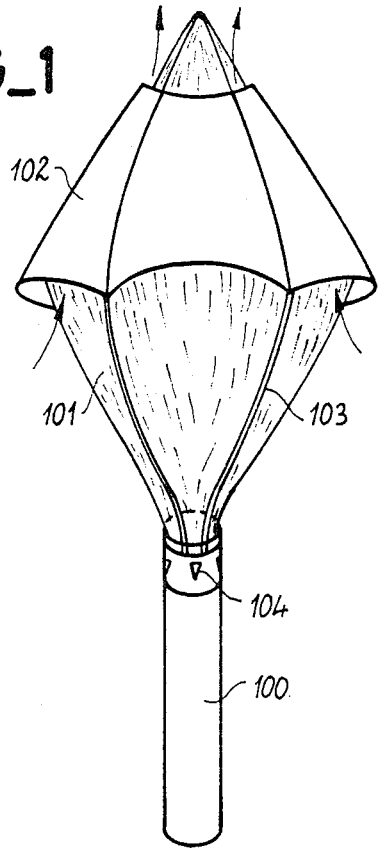
FIG. 1, a general view of a buoy of the invention.

The buoy of the invention shown in FIG. 1 has a body 100 suspended from a balloon 101. After being released, the balloon is extracted from the body of the buoy and opens out under the effect of the air which enters through triangular openings 104, formed on the upper part, called neck, of the body of the buoy.

The balloon has a set of pockets 102, six for example, into which the air surges through the wide lower part which is not fixed to the balloon and leaves through the narrower upper part, itself not fixed to the balloon. Thus, an effect is produced for stabilizing the trim of the buoy during its fall, as well as a certain braking force. To increase this braking with respect to that obtained in buoys known up to present, these pockets have a length which is at least equal to half the height of the balloon and they extend preferably slightly beyond the equator line of the balloon. Thus, an effect is obtained similar to that of a parachute.

The surface of the balloon is defined by a set of halyards 103 which extend from its top and are joined to its base while defining on the balloon a set of sectors. Fixing of these halyards to the balloon is preferably common with that of the lateral edges of pockets 102.

These halyards are formed for example by cords or fabric strips. They reinforce the balloon and at the same time fix it to the neck of the buoy thereinside. Thus, the lower open part of the balloon penetrates into the neck and is therefore not crimped thereabout, which gives a better mechanical strength to the assembly.

Figure 2:
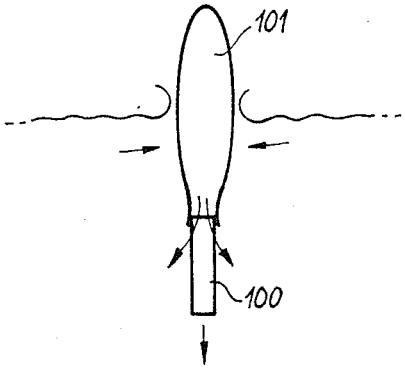
FIG. 2, a diagram for explaining the action of the water at the time of impact, and FIG. 3, a sectional view of the neck of the buoy of the invention, half during the fall and half during floating.

FIG. 2 shows what happens on impact of the buoy with the surface of the water. It can be seen that the balloon penetrates into the water to a depth which passes beyond its equator. Under these conditions, the balloon is compressed by the water pressure, as shown in an exaggerated way in the figure, and a part of the air escapes through openings 104. When the buoy then rises to the surface, water enters the balloon to replace the air which has thus left and the floatability of the assembly is poor. in numerous cases it has been noted that the buoy sinks.

The fall of the buoy could be further slowed down, using for example an auxiliary parachute, but this has the drawback of extending the fall excessively and considerably increasing the influence of the drift due to the wind.

In accordance with the invention a flexible sleeve is used which, during the fall, lets the air pass and after impact on the surface of the water turns inside out so as to close the air inlet openings.

Figure 3:
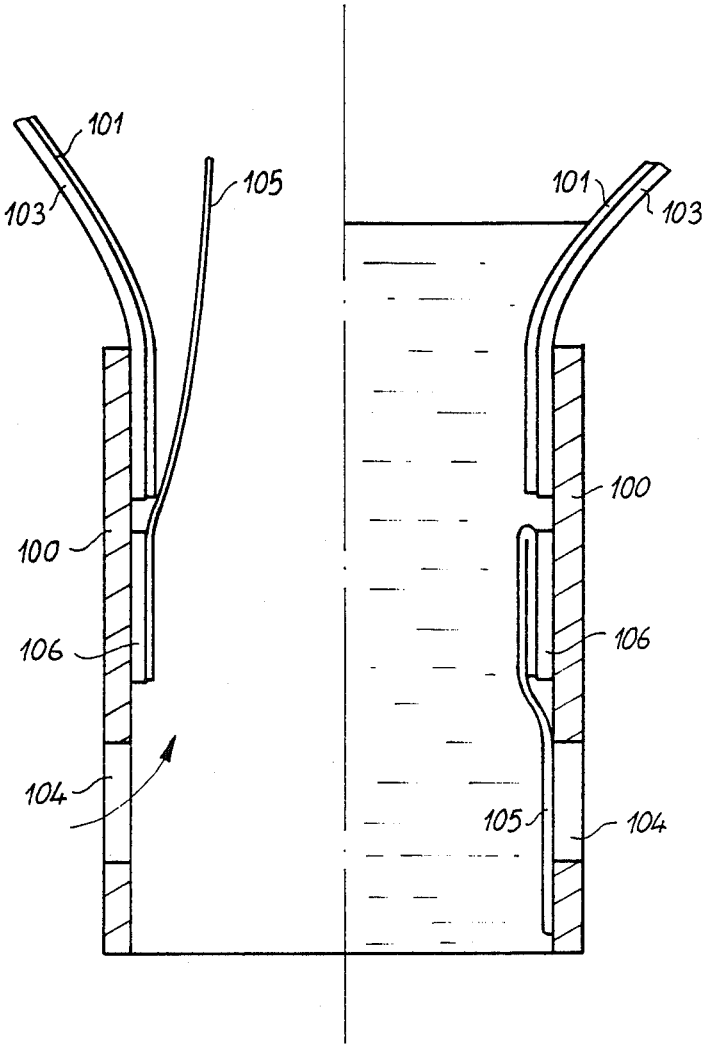

In FIG. 3 a partial sectional view has been shown of a buoy provided with such a sleeve. The left hand half of this figure shows the buoy during its fall through the atmosphere and the right hand half shows it when it is floating at the surface of the water.

Sleeve 105 made from a very flexible and very thin textile material, such for example as certain waterproof fabrics used for rainproof clothing which can be folded up in the pocket, is fixed inside the neck over the whole periphery thereof by means of a two-sided adhesive ribbon 106. This ribbon is bonded below the anchorage point of the halyards 103 and above the openings 104.

Thus, when the buoy drops through the atmosphere, the air entering through orifices 104 passes into sleeve 105 which lets this air pass while floating freely inside the balloon 101.

When the buoy strikes the surface of the water, a small amount of water, a few liters or so, enters the balloon under the effect of the impact. Then, when the balloon penetrates into the water, the pressure exerted on the walls thereof by the liquid mass, as shown in FIG. 2, tends to drive this water through orifices 104. On leaving, the water takes with it sleeve 105 which is very flexible and which is turned inside out like the sleeve of a garment when one takes it off. By turning inside out, sleeve 105 covers the whole internal lower face of the neck of the body 100 and closes the orifices 104, as can be seen in the right hand part of FIG. 3. Thus, a certain amount of the water which entered during impact remains imprisoned in the neck and in the lower part of the balloon and the air cannot escape therefrom. In fact, it will be readily understood that this air, which was already slightly compressed under the effect of the aerodynamic pressure of the fall, does not escape at the time of impact since it is the water which enters and since this water tends to increase the pressure of the air. Thus, when sleeve 105 has closed the orifices 104, the pressure of the air is sufficient in the balloon to maintain it sufficiently inflated so as to oppose the weight of the body of the buoy and causes it to rise to the surface of the water.

When the buoy is stabilized on the surface of the water, the residual pressure relayed by the remaining water column applies sleeve 105 against the lower internal wall of the neck and completely closes orifices 104. Thus, the balloon remains inflated without any problem, even in the presence of relatively large waves.

In a practical embodiment, a buoy was manufactured of a weight of about 15 kg, supported by a balloon of a capacity of 30 liters with six fall stabilizing pockets. The neck had six triangular openings, with downwardly turned apex, of a height of 50 mm for a width of 40 mm. The height of the sleeve was about 120 mm. Under these conditions, it was possible to measure that, after impact and reversal of the sleeve, there remained between 4 and 5 liters of water in the neck and the lower part of the balloon and that the percentage of failures of the buoys, namely the number which sank, was particularly low.

What is claimed is:

1. A releasable airborne buoy, particuarly for undersea listening purposes, including a body with a neck which closes its upper part, a balloon having a closed top and an open lower base and intended to slow down the fall of the buoy through the air and to maintain it at the surface of the water after impact thereon, means for inflating this balloon by means of the relative wind during the fall, a set of halyards fixed to the surface of the balloon between the top and the base thereof and being fixed inside said neck, the base of the balloon penetrating inside the neck, wherein the means for inflating the balloon include a set of openings situated at the lower part of the neck, and a flexible and waterproof sleeve fixed to the internal wall of the neck above the inflation openings; this sleeve allowing air to pass freely during the fall of the buoy and being turned inside out under the effect of the pressure exerted by the water on the buoy after impact for closing the inflation openings.

2. The buoy as claimed in claim 1, including a double sided adhesive ribbon for fixing said sleeve to the inner wall of said neck.

3. The buoy as claimed in claim 1, wherein the inflation openings have a triangular shape with the apex turned downwards.

* * * * *